US007235743B2

(12) United States Patent
Varkey

(10) Patent No.: US 7,235,743 B2
(45) Date of Patent: Jun. 26, 2007

(54) RESILIENT ELECTRICAL CABLES

(75) Inventor: Joseph P. Varkey, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/106,251

(22) Filed: Apr. 14, 2005

(65) Prior Publication Data

US 2006/0231286 A1 Oct. 19, 2006

(51) Int. Cl.
*H01B 7/18* (2006.01)

(52) U.S. Cl. ..... 174/102 R; 174/105 R; 174/116

(58) Field of Classification Search ..... 174/102 R, 174/105 R, 116
See application file for complete search history.

(56) References Cited

U.S. PATENT DOCUMENTS

| | | | | |
|---|---|---|---|---|
| 4,375,313 | A | 3/1983 | Anderson | 350/96.23 |
| 4,440,974 | A | 4/1984 | Naudet | 174/108 |
| 4,522,464 | A | 6/1985 | Thompson | 350/96.23 |
| 4,696,542 | A | 9/1987 | Thompson | 350/96.23 |
| 5,202,944 | A | 4/1993 | Riordan | 385/101 |
| 5,495,547 | A | 2/1996 | Rafie | 385/101 |
| 6,060,662 | A | 5/2000 | Rafie | 174/106 |
| 6,281,489 | B1 | 8/2001 | Tubel | 250/227.14 |
| 6,297,455 | B1 | 10/2001 | Wijnberg | 174/113 |
| 6,392,151 | B1 | 5/2002 | Rafie | 174/106 |
| 6,501,027 | B1 | 12/2002 | Belli | 174/110 |
| 6,531,694 | B2 | 3/2003 | Tubel | 250/227 |
| 6,600,108 | B1 | 7/2003 | Mydur | 174/120 |
| 6,768,060 | B2 | 7/2004 | Belli | 174/110 |
| 6,779,927 | B2 | 8/2004 | Cens | 385/84 |
| 7,009,113 | B2 * | 3/2006 | Varkey | 174/102 R |
| 2004/0045735 | A1 | 3/2004 | Varkey | 174/120 |

FOREIGN PATENT DOCUMENTS

| | | |
|---|---|---|
| WO | WO 96/41066 | 12/1996 |

* cited by examiner

*Primary Examiner*—Jinhee Lee
(74) *Attorney, Agent, or Firm*—David Cate; Jaime Castano; Dale Gaudier

(57) ABSTRACT

Compression, stretch, and crush resistant cables which are useful for welibores. The cables include insulated conductors, a compression and creep resistant jacket surrounding the insulated conductors, a filler material and compression resistant filler rods placed in interstitial spaces formed between the compression and creep resistant jacket and the insulated conductors, and at least one layer of armor wires surrounding the insulated conductor and compression and creep resistant jacket. The filler material may be a non-compressible filler material.

14 Claims, 3 Drawing Sheets

RESILIENT ELECTRICAL CABLES

BACKGROUND OF THE INVENTION

1. Field of the Invention

This invention relates to wellbore armored logging electric cables, as well as methods of manufacturing and using such cables. In one aspect, the invention relates to compression, stretch, and crush resistant cables which are dispatched into wellbores used with devices to analyze geologic formations adjacent a well before completion and methods of using same.

2. Description of the Related Art

Generally, geologic formations within the earth that contain oil and/or petroleum gas have properties that may be linked with the ability of the formations to contain such products. For example, formations that contain oil or petroleum gas have higher electrical resistivity than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein. Accordingly, it may be desirable to measure various characteristics of the geologic formations adjacent to a well before completion to help in determining the location of an oil- and/or petroleum gas-bearing formation as well as the amount of oil and/or petroleum gas trapped within the formation.

Logging tools, which are generally long, pipe-shaped devices, may be lowered into the well to measure such characteristics at different depths along the well. These logging tools may include gamma-ray emitters/receivers, caliper devices, resistivity-measuring devices, neutron emitters/receivers, and the like, which are used to sense characteristics of the formations adjacent the well. A wireline armored logging cable connects the logging tool with one or more electrical power sources and data analysis equipment at the earth's surface, as well as providing structural support to the logging tools as they are lowered and raised through the well. Generally, the wireline cable is spooled out of a drum unit from a truck or an offshore set up, over pulleys, and down into the well.

Wireline cables are typically formed from a combination of metallic conductors, insulative material, filler materials, jackets, and armor wires. The jackets usually encase a cable core, in which the core contains metallic conductors, insulative material, filler materials, and the like. Armor wires usually surround the jackets and core. The insulated conductors are typically placed at or near the core. Commonly, the useful life of a wellbore electric cable is typically limited to only about 6 to 24 months. In the downhole environment, wireline cables are subject to pressures that can exceed 25,000 psi and temperatures in excess of 450° F. At such high pressures, insulating material on conductors can creep due to the high compression force, leading to potential conductor failure. Also, in typical wireline cable construction, cotton yams are cabled into the interstitial spaces between the conductors to expedite the cable core assembly process and provide a close to cylindrical surface to permit easy extrusions or helical laying of metallic wires, although these yams are compressible as well. When a typical cable is placed under high compressive forces, the yam compresses and contributes to deformation of the cable core containing the insulated conductors.

Commonly, polymeric jackets are placed over the cores of wireline cables. These polymeric jackets protect the core and the electrical transmittance media from the hostile chemical environment that the wireline logging cables encounter during deployment. Under high hydrostatic pressures and tension, the jacket material potentially creeps into spaces formed between the armor wires, and between the armor wires and cable core, and does not return to its original shape or position. After the cable is retrieved from the wellbore, the core becomes permanently deformed, and the insulation on helical conductors may creep into the armor wires, significantly diminishing, or eliminating, the electrical transmittance capability of the cable. Also, as the cable becomes deformed, it may also be more prone to damage from crushing as the cable, for instance, is dispatched from the spool into the wellbore over a sheave or at crossover points on the drum at high tension.

Protection against cable compression damage is typically achieved by minimizing space in the core between insulated conductors using filler materials. Unfortunately, these design approaches still result in cables which are prone to compression damage, as most compression damage is still related to the performance of cotton yarn and highly flowable polymeric jacket materials. Compression and tension forces coupled with weakness of the yarn and/or polymeric jacket material may result in flow of the filler material, and thus cable deformation.

Thus, a need exists for wellbore electric cables that are resistant to compression, stretch, and crush damage as well as being resistant to material creep at both elevated temperatures and pressures. An electrical cable that can overcome one or more of the problems detailed above while conducting larger amounts of power with significant data signal transmission capability would be highly desirable, and the need is met at least in part by the following invention.

BRIEF SUMMARY OF THE INVENTION

In one aspect of the invention, a wellbore electrical cable is provided. The cable includes at least one insulated conductor, a compression and creep resistant jacket comprising a carbon fiber material surrounding the insulated conductor, a filler material placed in interstitial spaces formed between the compression and creep resistant jacket and the insulated conductor, and at least one layer of armor wires surrounding the insulated conductor and compression and creep resistant jacket. The cable may further include a fiber reinforced tape wherein the tape is surrounded by the compression and creep resistant jacket, the insulated conductor may contain a plurality of metallic conductors encased in the insulation layer, and the insulation layer may be a stacked dielectric design. The compression resistant and creep jacket may be made of a polymeric material such as polyolefins, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy, fluorinated ethylene propylene, a ethylene-tetrafluoroethylene polymer, ethylene chloro-trifluoroethylene, polytetrafluoroethylene-perfluoromethylvinylether, and any mixtures thereof. The filler material may be a non-compressible filler material.

In some cable embodiments of the invention, multiple insulated conductors are used in the core, to form a cable such as a heptacable. Cables may also include a soft jacket encasing the compression and creep resistant jacket. The soft jacket may be made of the same polymeric material as the compression and creep resistant jacket or a different polymeric material. Also, the soft jacket and the compression and creep resistantjacket may be chemically and/or mechanically bonded with one another, or even remain unbonded. Further, cables according to the invention may contain compression resistant filler rods in the interstitial spaces formed between the compression and creep resistant jacket and the insulated conductor.

The invention also relates to a method for manufacturing a wellbore cable including providing at least one insulated conductor comprising a polymeric insulating material wherein the insulating may be formed by extruding a first polymeric material layer having a first dielectric constant over a conductor, and then extruding a second polymeric material layer having a second dielectric constant over the first polymeric material layer, then optionally providing at least one compression resistant filler rod, and disposing a filler material in the interstitial volumetric spaces formed between a compression and creep resistant jacket containing carbon fibers, the compression resistant filler rod, and the insulated conductor. Then, a glass fiber reinforced polymeric tape may be served over the cable core which contains the insulated conductor, filler material, and compression resistant filler rods. A compression and creep resistant jacket containing carbon fibers is then extruded over an optional tape and cable core, and a soft jacket may be extruded over the compression and creep resistant jacket. Lastly, two counter helical metallic armor wire layers may be served thereupon.

BRIEF DESCRIPTION OF THE DRAWINGS

The invention may be understood by reference to the following description taken in conjunction with the accompanying drawings.

DETAILED DESCRIPTION OF EMBODIMENTS OF THE INVENTION

Figure 1:
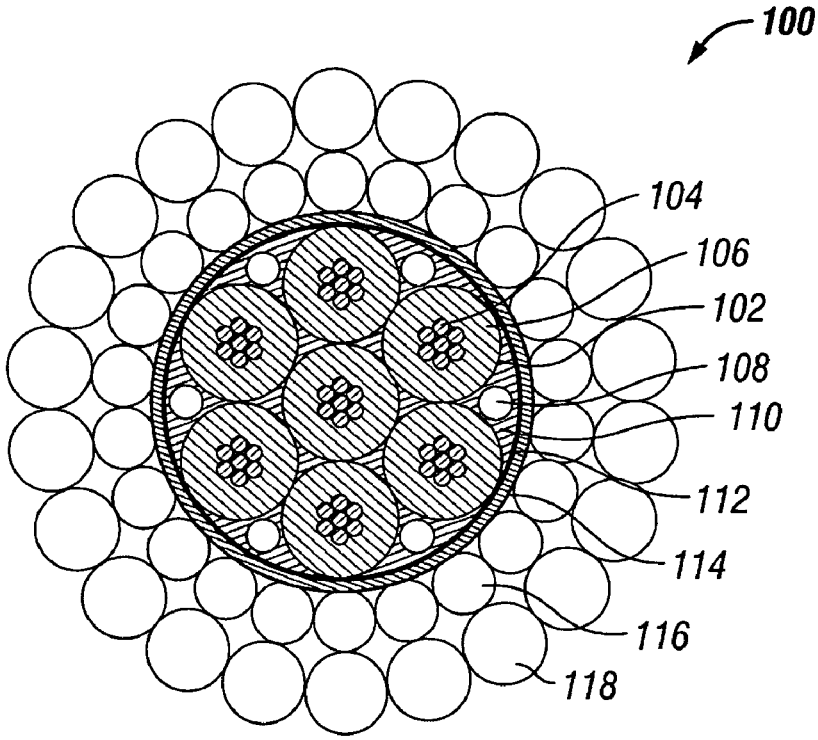
FIG. 1 (Prior Art)
FIG. 1 depicts a cross-section of a typical prior art cable design used for downhole applications.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to wellbore cables and methods of manufacturing the same, as well as uses thereof. In one aspect, the invention relates to resilient electrical cables used with devices to analyze geologic formations adjacent a wellbore, methods of manufacturing the same, and uses of the cables in seismic and wellbore operations. Cables according to the invention described herein are resistant to compression, stretch, and crush damage as well as material creep at elevated temperatures and/or pressures, therefore extending the useful life of the cable, especially in wellbore applications.

It has been discovered that placing a compression and creep resistant jacket around the cable core provides a resilient jacketing layer that is resistant to creep. Additionally, including a compression-resistant filler rod and/or non-compressible filler material in the core may further improve the resiliency and creep resistance of the cable. Operationally, cables according to the invention eliminate the cable life problems of prior art cables due to compressing, creeping, and crushing weakness.

Cables of the invention generally include at least one insulated conductor, at least one layer of armor wires surrounding the insulated conductor, a compression and creep resistant jacket encasing the core, and a filler material, which may be non-compressible, disposed in the interstitial spaces formed between the jacket and insulated conductor. Insulated conductors useful in the embodiments of the invention include metallic conductors, or even one or more optical fibers, encased in an insulated jacket. Any suitable metallic conductors may be used. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors. Insulated jackets may be prepared from any suitable materials known in the art.

In cable embodiments of the invention, one or more insulated conductors may comprise at least one optical fiber. Any commercially available optical fibers may be used. The optical fibers may be single-mode fibers or multi-mode fibers, which are either hermetically coated or non-coated.

When hermetically coated, a carbon or metallic coating is typically applied over the optical fibers. An optical fiber may be placed in any location in a standard wireline cable core configuration. Optical fibers may be placed centrally or helically in the cable. One or more further coatings, such as, but not limited to, acrylic coatings, silicon coatings, silicon/PFA coatings, silicon/PFA/silicone coatings or polyimide coatings, may be applied to the optical fiber. Coated optical fibers which are commercially available may be given another coating of a soft polymeric material such as silicone, EPDM, and the like, to accommodate embedment of any metallic conductors served around the optical fibers. Such a coating may allow the space between the optical fiber and metallic conductors to be completely filled, as well as reduction in the attenuation of optical fiber's data transmission capability.

Placing optical fibers in various positions and areas of the cable creates a wide variety of means to monitor well bore activity and conditions. When the optical fiber is placed in a helical position inside the cable, measurements of downhole physical properties, such as temperature or pressure, among many others, are quickly acquired. Conversely, placing the optical fiber in a central position upon the center axis of the cable allows for strain measurements.

Examples of suitable insulated jacket materials used in insulated conductors include, but are not necessarily limited to, polytetrafluoroethylene-perfluoromethylvinylether polymer (MFA), perfluoro-alkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) (TPX® available from Mitsui Chemicals, Inc.), other polyolefins, other fluoropolymers, polyaryletherether ketone polymer (PEEK), chlorinated ethylene propylene polymer, polyphenylene sulfide polymer (PPS), modified polyphenylene sulfide polymer, polyether ketone polymer (PEK), maleic anhydride modified polymers, Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof.

In some embodiments of the invention, the insulated conductors are stacked dielectric insulated conductors, with electric field suppressing characteristics, such as those used in the cables described in U.S. Pat. No. 6,600,108 (Mydur, et al.), hereinafter incorporated by reference. Such stacked dielectric insulated conductors generally include a first insulating jacket layer disposed around the metallic conductors wherein the first insulating jacket layer has a first relative permittivity, and, a second insulating jacket layer disposed around the first insulating jacket layer and having a second relative permittivity that is less than the first relative permittivity. The first relative permittivity is within a range of about 2.5 to about 10.0, and the second relative permittivity is within a range of about 1.8 to about 5.0.

Cable embodiments according to the invention include a compression and creep resistant jacket that may comprise a carbon fiber material, where the jacket surrounds the cable core. The jacket preferably includes at least a polymeric material and a carbon fiber component. While any polymeric material that provides a compression-resistant jacket may be used, suitable examples include, but are not necessarily limited to, polyolefins, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy, fluorinated ethylene propylene, a ethylene-tetrafluoroethylene polymer, ethylene chloro-trifluoroethylene (such as Halar®), polytetrafluoroethylene-perfluoromethylvinylether, and any mixtures thereof. Particularly useful polymeric materials include polyaryletherether ketone, perfluoroalkoxy polymer, and fluorinated ethylene propylene polymers. The carbon fiber component useful in the jacket may be any suitable carbon fiber material. Preferably, the carbon fiber material has an average length of about 127 mm or less, and is included in the compression resistant jacket in an amount of about 30% or less by weight of total jacket weight. More preferably, the carbon fiber material is incorporated in amount of about 10% or less by weight of total jacket weight. The carbon fiber component may be shortened in length, by milling for example, to optimize the elongation properties of the jacket.

Alternatively, the compression and creep resistant jacket of some cable embodiments may comprise other fibrous materials including, but not necessarily limited to, glass fibers, Kevlar® fibers, quartz, Vectran®, and the like.

The compression and creep resistant jackets over the cable core may serve other purposes as well. For example, the jacket may serve as a barrier against harmful downhole fluids. The jackets may also provide a gripping surface for the armor wires. This gripping surface may help the materials in the wireline cable (which have differing stretch coefficients) stretch as a cohesive unit. Traditional polymers suitable to provide crush, creep, and compression resistance tend to be relatively hard and slick, where armor wires do not readily embed in such, thereby minimizing any effectiveness as a gripping surface.

Compression-resistant filler rods are placed in the interstices formed between the compression and creep resistant jacket and insulated conductor(s) in the core of some cables according to the invention. Further, compression-resistant filler rods may be compression-resistant rods with a compression-resistant polymer is encasing the rod. The filler rods may be formed of several tightly twisted synthetic yarns, or monofilaments. Materials used to prepare the compression-resistant filler rods include, but are not necessarily limited to tetrafluoroethylene (TFE), polyphenylene sulfide (PPS), polyetheretherketone (PEEK), polyetherketone (PEK), fluoropolymers, and synthetic fibers, such as polyester, polyamides, Kevlar®, Vectran®, glass fiber, carbon fiber, quartz fiber, and the like. Examples of compression-resistant polymers used to encase the filler rod include, by nonlimiting example, Tefzel®, MFA, perfluoroalkoxy resin (PFA), fluorinated ethylene propylene (FEP), polyphenylene sulfide (PPS), polyetheretherketone (PEEK), polyolefins (such as [EPC] or polypropylene [PP]), carbon-fiber reinforced fluoropolymers, and the like. These compression-resistant filler rods may also minimize damage to optical fibers since the cable will better maintain geometry in circumstances where high tension is applied.

Cables according to the invention include at least one layer of armor wires surrounding the insulated conductor. The armor wires may be generally made of any high tensile strength material including, but not necessarily limited to, galvanized improved plow steel, alloy steel, or the like. In preferred embodiments of the invention, cables comprise an inner armor wire layer surrounding the insulated conductor and an outer armor wire layer served around the inner armor wire layer. A protective polymeric coating may be applied to each strand of armor wire for corrosion protection or even to promote bonding between the armor wire and the polymeric material disposed in the interstitial spaces. As used herein, the term bonding is meant to include chemical bonding, mechanical bonding, or any combination thereof. Examples of coating materials which may be used include, but are not necessarily limited to, fluoropolymers, fluorinated ethylene propylene (FEP) polymers, ethylene-tetrafluoroethylene polymers (Tefzel®), perfluoro-alkoxyalkane polymer (PFA), polytetrafluoroethylene polymer (PTFE), polytetrafluoroethylene-perfluoromethylvinylether polymer (MFA), polyaryletherether ketone polymer (PEEK), or polyether ketone polymer (PEK) with fluoropolymer combination, polyphenylene sulfide polymer (PPS), PPS and PTFE combination, latex or rubber coatings, and the like. Each armor wire may also be plated with materials for corrosion protection or even to promote bonding between the armor wire and polymeric material. Nonlimiting examples of suitable plating materials include brass, copper alloys, nickel alloys, and the like. Plated armor wires may even be cords such as tire cords. While any effective thickness of plating or coating material may be used, a thickness from about 10 microns to about 100 microns is preferred.

Filler materials are disposed in the interstitial spaces formed between the compression and creep resistant jacket and insulated conductor. Suitable examples of filler materials which are non-compressible, include, but are not necessarily limited to polymers of ethylene propylene diene monomer (EPDM), nitrile rubbers, butyl-nitrile rubbers, fluoropolymers, and the like.

Cables according to the invention may be of any practical design, including monocables, coaxial cables, quadcables, heptacables, and the like. In coaxial cable designs of the invention, a plurality of metallic conductors surround the insulated conductor, and are positioned about the same axis as the insulated conductor. Also, for any cables of the invention, the insulated conductors may further be encased in a tape. All materials, including the tape disposed around the insulated conductors, may be selected so that they will bond chemically and/or mechanically with each other. Cables of the invention may have an outer diameter from about 1 mm to about 125 mm, and preferably, a diameter from about 2 mm to about 12 mm.

The materials forming the insulating layers and the jacket materials used in the cables according to the invention may further include a fluoropolymer additive, or fluoropolymer additives, in the material admixture to form the cable. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof. The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer. The fluoropolymer additive should have a melting peak temperature below the extrusion processing temperature, and preferably in the range from about 200° C. to about 350° C. To prepare the admixture, the fluoropolymer additive is mixed with the insulating jacket or polymeric material. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Components used in cables according to the invention may be positioned at zero lay angle or any suitable lay angle relative to the center axis of the cable. Generally, a central insulated conductor is positioned at zero lay angle, while those components a surrounding the central insulated conductor are helically positioned around the central insulated conductor at desired lay angles. A pair of layered armor wire layers may be contra wound, or positioned at opposite lay angles.

FIG. 1 depicts a cross-section of a typical prior art cable design used for downhole applications. The cable 100 includes at least one insulated conductor (only one indicated) 102 having multiple conductors 104 and a polymeric insulating material 106. The cable 100 may further include interstitial filler yams (only one indicated) 108, such as a cotton yam, and an interstitial filler material 110 surrounding the insulated conductors 102. A tape and/or tape jacket 112 encircles the cable core containing the insulated conductors 102, filler yams 108, and interstitial filler material 110. The tape 112 is encased in an incompressible and creep prone jacket 114. A first armor layer 116 and a second armor layer 118, generally made of a high tensile strength material such as galvanized improved plow steel, alloy steel, or the like, surround the jacket 114.

Figure 2:
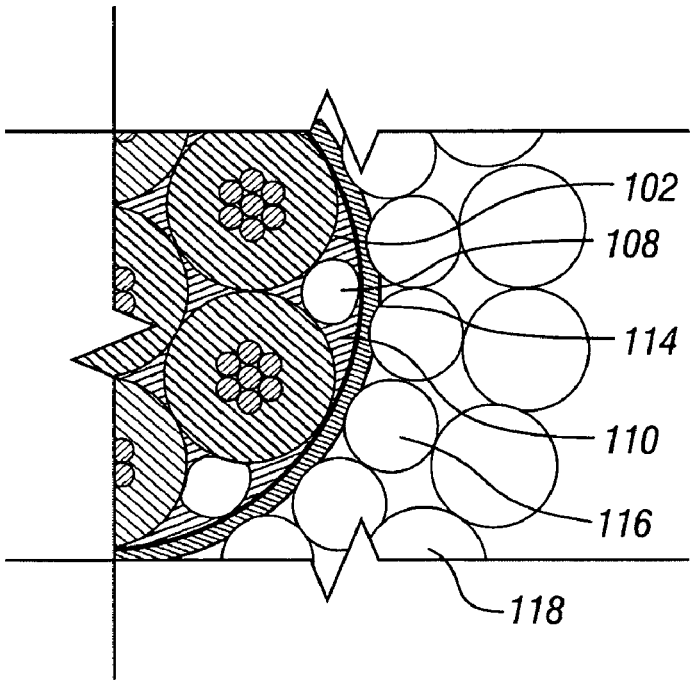
FIG. 2 (Prior Art)
FIG. 2, illustrates by cross-sectional representation the damaging effects of compression and creep on prior art cables.

FIG. 2, illustrates by cross-sectional representation the damaging effects of compression on prior art cables. Referring herein to cable 100 as illustrated in FIG. 1, under compressive loads of about 400 kgs to about 2500 kgs, for example, which may be encountered in such operations as respooling a cable onto a drum while under tension, or even shallow well logging, interstitial filler yams 108 may become compressed and deform. Deformation of the yams 108 leads to displacement and deformation of the filler 110 and insulated conductor 102. Such deformation ultimately leads to displacement and deformation of the jacket 114 to the extent that the jacket 114 may be squeezed into the gaps between armor wires 116 and 118. Displacement of the jacket 114 ultimately results in cable failure as the electrical conductive integrity of the insulated conductors 102 is compromised. In the case of deviated/horizontal wells, the required pulling loads at the well surface can exceed 8,000 kgs. At such loads, or even above 5,000 kgs, commonly used non-reinforced thermoplastic jackets are prone to creep into the interstices between individual armor wires, which typically leads to cable failure.

Figure 3:
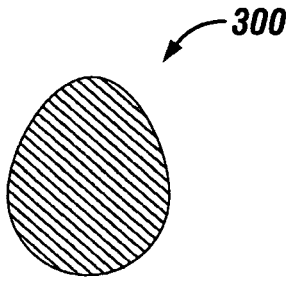
FIG. 3 (Prior Art)
FIG. 3 is a stylized cross-sectional representation of deformed fluoropolymer filler rods used in some prior art cables which are not extruded over an internal structure.

In some embodiments of the invention, standard cotton yarn interstitial fillers are replaced with compression-resistant polymer rods. Traditionally, extruding pure polymer rods is known to be difficult and often impractical. Fluoropolymers are commonly used in wireline cable applications due to their outstanding chemical resistance. Unfortunately, when fluoropolymers are not extruded over an internal structure, as shown in FIG. 3, the symmetry and integrity may be compromised. Attempting to extrude long fluoropolymer rods without a core structure typically leads to rod deformation during the cooling process. As a result, making long lengths of high-temperature, high-diameter tolerance fluoropolymer rods with a high degree of symmetry may not be practically feasible. Another concern during the cabling process is that the rods may stretch making them prone to breaks or variation in diameter.

Figure 4:
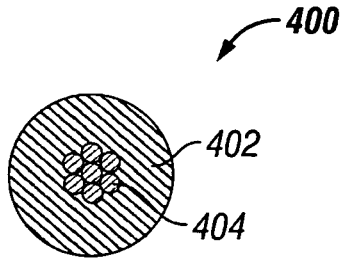
FIG. 4 is a stylized cross-sectional representation of a compression-resistant filler rod which includes compression-resistant polymer extruded over a compression-resistant rod, such as tightly twisted synthetic yarn.

Referring to FIG. 4, the problem shown in FIG. 3 may be improved by extruding a compression-resistant polymer 402 over a compression-resistant rod, such as tightly twisted synthetic yarn, 404. As illustrated in FIG. 4, the polymer 402 is compression extruded to a final diameter of about 350 microns to about 1000 microns over a tightly twisted yarn 404 with a diameter of between about 125 microns to about 500 microns. The inner structure provided by the tightly twisted yarn 404 is sufficient to maintain the round profile as the rod cools. This structure also allows for higher extrusion speeds without rod deformation, as well as preventing stretching during the cabling process. The structure 404 may also be a fiber reinforced composite rod or even solid monofilament.

Figure 5:
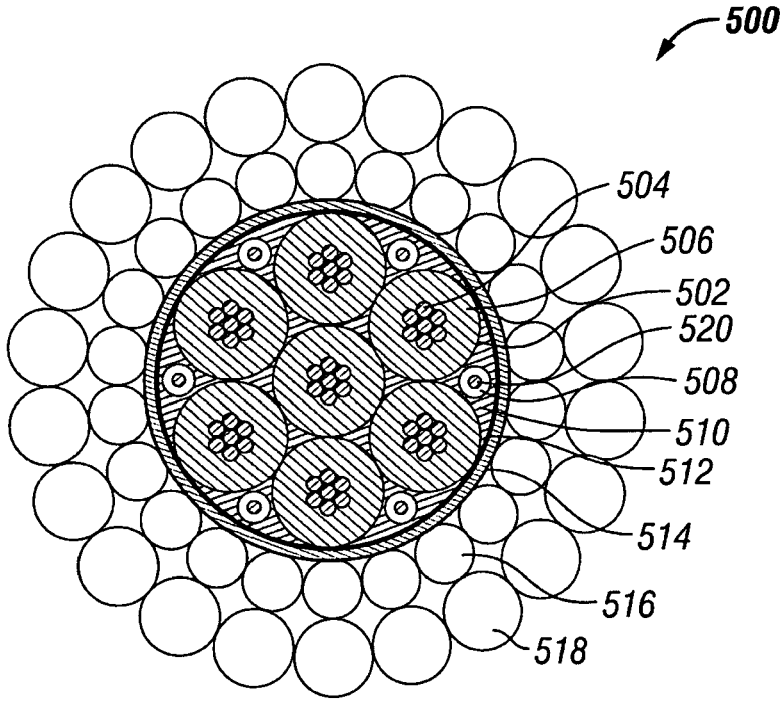
FIG. 5 is a cross-section illustration of a heptacable embodiment according the invention.

FIG. 5 illustrates a cable embodiment according to the invention, which is a heptacable design. In FIG. 5, the cable 500 includes seven insulated conductors (only one indicated) 502 having multiple conductors 504 and a polymeric insulating material 506. The cable 500 further includes a compression-resistant filler rod (only one indicated) 508, and a non-compressible filler material 510 placed in the interstitial spaces formed between the compression and creep resistant jacket containing a carbon fiber 514 and insulated conductors 502. An optional tape 512 may encircle the cable core containing the insulated conductors 502, compression-resistant filler rods 508, and non-compressible filler material 510. A first armor layer 516 and a second armor layer 518, both generally made of a high tensile strength material such as galvanized improved plow steel, alloy steel, or the like, surround the jacket 514. The compression-resistant filler rod 508 contains a compression-resistant polymer extruded over a compression-resistant rod, such as a tightly twisted synthetic yam, 520, or even a reinforced long or short fiber composite rod.

In one method of preparing a cable, such as a cable similar to cable 500 as depicted in FIG. 5, at least one insulated conductor 502 is provided where the polymeric insulating material 506 is formed by extruding a first polymeric material layer over the conductor 504 having a first dielectric constant, and extruding a second polymeric material layer having a second dielectric constant, that is smaller than the first, over the first polymeric material layer. Seven of such insulated conductors 502 are bunched together, a central insulated conductor positioned upon the central axis of the cable, and the remaining insulated conductors helically wound thereupon. The interstitial volumetric spaces formed between the compression and creep resistant jacket 514 and insulated conductors 502 are filled with a filler material 510. Seven compression resistant filler rods 508 are also helically positioned in the interstitial volumetric spaces. A glass fiber reinforced polymeric tape 512 is placed over the cable core containing the insulated conductors 502, filler material 510, compression resistant filler rods 508. A compression and creep resistant jacket containing short carbon fibers 514 is extruded over the tape 512, insulated conductors 502, filler material 510, and compression resistant filler rods 508. A soft jacket, that is allowed to creep, made of the same polymeric material as the compression and creep resistant jacket containing carbon fibers 514, but without the carbon fiber, is then extruded over the compression and creep resistant jacket containing carbon fibers 514. Then, two counter helical metallic armor wire layers, 516 and 518, are disposed thereupon.

Figure 6:
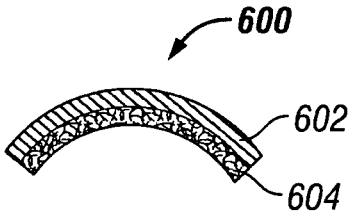
FIG. 6 is a cross-sectional representation of a jacket including a soft jacket made of polymeric material that surrounds a compression and creep resistant jacket comprising a carbon fiber material.
Figure 7:
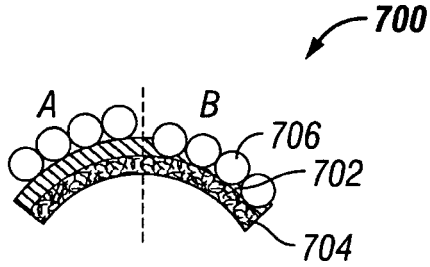
FIG. 7 is a cross-sectional representation of a cable jacket including a soft jacket over a compression resistant and creep jacket comprising a carbon fiber material when the cable under tension and compression as well as under no load.

As described hereinabove, some cable embodiments of the invention may use a soft jacket made of polymeric material which surrounds the compression and creep resistant jacket comprising a carbon fiber material. Such designs provide compression, creep and crush resistance, as well as a gripping surface. As shown in FIG. 6, a cross-sectional representation of a jacket including a soft jacket, a soft jacket 602 is extruded over the compression and creep resistant jacket comprising a carbon fiber material 604. The soft jacket 602 may be allowed to creep into and fill the space formed between a first armor layer and compression/creep resistant jacket comprising a carbon fiber material 604. Both jackets 602 and 604 are composed of the same polymeric material. Because the same polymer is used for both layers, the layers are chemically and mechanically bonded. As the outer soft jacket 602 provides a gripping surface, the armor wires may imbed in such. As shown in FIG. 7, which is a cross-sectional representation of a cable jacket including a soft jacket 702 over a compression and creep resistant jacket comprising a carbon fiber material 704, when the cable is placed under tension and compression, scenario B, the armor wires 706 may embed the outer soft jacket 702, which is allowed to creep into and fill the space formed between a first armor layer and compression and creep resistant jacket comprising a carbon fiber material 704, but will be stopped by the compression and creep resistant jacket 704. When the cable is not under any load, scenario A, the armor wires 706 may be slightly embedded, into the outer soft jacket 702.

Alternatively, in some embodiments of the invention, the soft jacket 702 may be used to fill the interstitial spaces formed between the compression and creep resistant jacket 704 and first layer of armor wires 706. This may be accomplished in one method, by applying heat as the first armor wire is laid upon on soft jacket in the cabling process. In such a case, when the cable is under tension, little to no compression occurs as the compression and creep resistant jacket 704 does not permit further creep. This may provide a cable with very low stretching under high tension.

Figure 8:
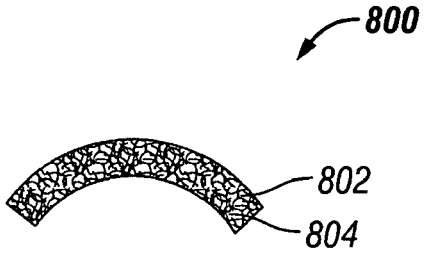
FIG. 8 is a cross section which illustrates a cable where compression and creep resistant jacket is made of a polymer amended with short carbon fibers.
Figure 9:
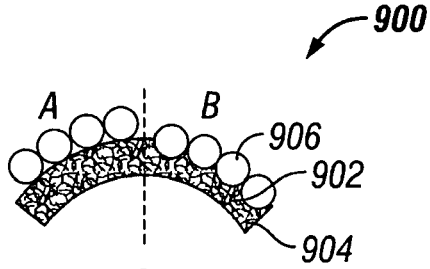
FIG. 9 is a cross-sectional representation of a compression and creep resistant jacket made of a polymeric material and short carbon fibers when the cable is placed under tension and compression as well as under no load.

In other embodiments of cables according to the invention, the compression and creep resistantjacket is made of a polymeric material and short carbon fibers, as illustrated in FIG. 8. In FIG. 8, the outer layer 802 and the inner layer 804 of the compression resistant and creep jacket 800 are composed of the same materials. As shown in FIG. 9, which is a cross-sectional representation of a compression and creep resistantjacket made of a polymeric material and short carbon fibers, while the cable is not under tension or load, in scenario A, armor wires 906 may not be significantly embedded, but may still have adequate gripping with jacket 902. Alternatively, during the armoring and pre-stressing stage, the core may be heated to allow the armor wires to partially embed into the hard jacket, or even fill the space between the armor wires 906 and the compression and creep resistant-jacket. After cooling, the jacket hardens to provide compression, creep, and crush resistance. When placed under tension or load, scenario B, the armor wires resist biting into the jacket significantly as the jacket is creep resistant while the space between the armor wires and jacket are filled during embedding in the armoring process.

Figure 10:
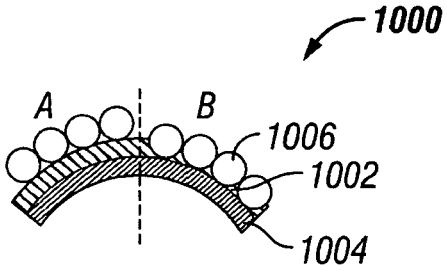
FIG. 10 is a cross section illustrating a cable where the jacket comprises a soft jacket and compression and creep resistant jacket where the two layers may slip relative to one another.

In yet other embodiments of cables of the invention, the jacket surrounding the core comprises a soft jacket over a compression and creep resistant jacket where the two layers are not bonded and thus may slip relative to each other. Referring to cable jacket 1000 illustrated in FIG. 10, different polymers are used for the inner compression and creep resistant jacket 1004 and outer jackets 1002, placed over the wireline cable core. The outer jacket 1002 is softer, hence a soft jacket, which allows the armor wires 1006 to embed and grip while under tension and compression, scenario B. Under excess tension, the armor wires 1006 may further embed into the soft jacket 1002, but will not embed into compression and creep resistant jacket 1004. As stated above, both jacket materials can be chosen such that they do not bond together, thereby providing a slipping interface between the jackets 1002 and 1004. When the cable is not under any load, scenario A, the armor wires 1006 may not be embedded, or only slightly embedded, into the soft jacket 1002.

Figure 11:
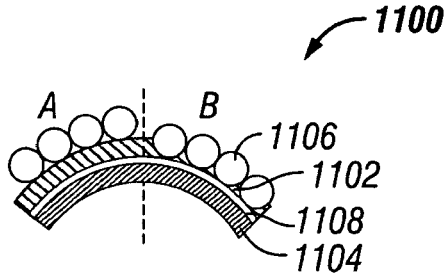
FIG. 11 is a cross section illustrating a cable embodiment of the invention where a soft outer jacket is bonded to a compression and creep resistant inner jacket, both encasing the cable core.

Referring now to FIG. 11, which is a cable embodiment of the invention where a soft outer jacket is bonded to a compression and creep resistant inner jacket. As shown in FIG. 11, an outer soft jacket 1102 and compression and creep resistant jacket 1104 are layered and bonded together by adding a bonding layer 1108. The bonding layer may be based upon a polyethylene compatibilizer. A common polyethylene compatibilizer is polyethylene grafted with unsaturated anhydrides, such as maleic anhydride, norbornene-2 3-dicarboxylic anhydride (NBDCA), and the like. The unsaturated anhydrides may react with the amine groups of nylon or even the alcohol groups of ethylene vinyl alcohol polymers or even polyurethane polymers, for example. The bonding layer may also be based upon polypropylene copolymer compatibilizers, such as ethylene propylene copolymer grafted with unsaturated anhydrides. Polypropylene compatiblizers could also be used, such as polypropylene copolymer grafted with unsaturated anhydrides such as maleic anhydride, norbornene-2 3-dicarboxylic anhydride (NBDCA), and the like. Other functional groups such as carboxylic acids or silanes may be grafted thereupon and used as well. Compatibilizers based upon fluoropolymers that are capable of bonding to other fluoropolymers or polar polymers, such as nylon, may be used as well. Also, compatibilizers based upon fluorpolymers or polyethere ketones that are capable of bonding with polyetherketones are useful also.

Once again, referring to FIG. 11, The compression and creep resistant jacket 1104 reduces the possibility of compression, creep, or crush damage, while the soft jacket 1102 allows the armor wires 1106 to partially embed and grip while under tension, load, and/or compression, as shown in scenario B. The bonding layer 1108 bonds the two layers to each other, further enhancing the armor wires' 1106 grip on the jacket, and hence cable core. When the cable is not under any load, scenario A, the armor wires 1106 may not be embedded, or only slightly embedded, into the soft jacket 1102.

Cables of the invention may include armor wires employed as electrical current return wires which provide paths to ground for downhole equipment or tools. The invention enables the use of armor wires for current return while minimizing electric shock hazard. In some embodiments, the polymeric material isolates at least one armor wire in the first layer of armor wires thus enabling their use as electric current return wires.

Cables according to the invention may be used with wellbore devices to perform operations in wellbores penetrating geologic formations that may contain gas and oil reservoirs. The cables may be used to interconnect well logging tools, such as gamma-ray emitters/receivers, caliper devices, resistivity-measuring devices, seismic devices, neutron emitters/receivers, and the like, to one or more power supplies and data logging equipment outside the well. Cables of the invention may also be used in seismic operations, including subsea and subterranean seismic operations. The cables may also be useful as permanent monitoring cables for wellbores.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The Invention claimed is:

1. An electrical cable comprising:

(a) a central insulated conductor and six insulated conductors helically positioned around, and in contact with, the central insulated conductor;

(b) a compression and creep resistant jacket comprising a carbon fiber material surrounding the insulated conductor;

(c) six compression resistant filler rods and a filler material placed in interstitial spaces formed between the compression and creep resistant jacket and the central insulated conductor, wherein one filler rod is positioned in each of the interstitial spaces; and (d) at least one layer of armor wires surrounding the central insulated conductor and the compression and creep resistant jacket.

2. A cable according to claim 1 further comprising a fiber reinforced tape, wherein the tape is surround by the compression and creep resistant jacket.

3. A cable according to claim 1 wherein the central insulated conductor comprises a plurality of metallic conductors encased in an insulation layer.

4. A cable according to claim 1 wherein the compression and creep resistant jacket comprises a polymeric material selected from the group consisting of polyolefins, polyaryletherether ketone, polyaryl ether ketone, polyphenylene sulfide, modified polyphenylene sulfide, polymers of ethylene-tetrafluoroethylene, polymers of poly(1,4-phenylene), polytetrafluoroethylene, perfluoroalkoxy, fluorinated ethylene propylene, chlorinated ethylene propylene, ethylene chloro-trifluoroethylene, polytetrafluoroethylene-perfluoromethylvinylether, and any mixtures thereof.

5. A cable according to claim 1 wherein the compression and creep resistant jacket comprises a ethylene-tetrafluoroethylene polymer.

6. A cable according to claim 1 wherein the compression and creep resistant jacket comprises a perfluoroalkoxy polymer.

7. A cable according to claim 1 wherein the compression and creep resistant jacket comprises a fluorinated ethylene propylene polymer.

8. A cable according to claim 1 wherein the central insulated conductor comprises seven insulated conductors forming interstices between each of the insulated conductors, and between six of the insulated conductors and compression and creep resistant jacket, and wherein the interstices are filled with a non-compressible filler material.

9. A cable according to claim 1 wherein the six compression-resistant filler rods comprises a compression-resistant rod and a compression-resistant polymer-encasing the rod.

10. A cable according to claim 1 which is a monocable, a quadcables, a heptacable or a coaxial cable.

11. A cable according to claim 1 wherein the at least one layer of armor wires comprises-a first inner armor wire layer and second outer armor wire layer.

12. A cable according to claim 1 as used in wellbore operations, well logging operations, or seismic operations.

13. A cable according to claim 1 wherein the compression and creep resistant jacket comprises carbon fibers.

14. A cable according to claim 1 wherein the compression and creep resistant jacket comprises a polyaryletherether ketone polymer.

* * * * *